US005741998A

United States Patent [19]

Hinshaw et al.

[11] Patent Number: 5,741,998

[45] Date of Patent: Apr. 21, 1998

[54] PROPELLANT FORMULATIONS BASED ON DINITRAMIDE SALTS AND ENERGETIC BINDERS

[75] Inventors: Carol J. Hinshaw, Ogden; Robert B. Wardle, Logan; Tom K. Highsmith, North Ogden, all of Utah

[73] Assignee: Thiokol Corporation, Ogden, Utah

[21] Appl. No.: 614,303

[22] Filed: Mar. 12, 1996

Related U.S. Application Data

[63] Continuation-in-part of Ser. No. 52,035, Apr. 21, 1993, Pat. No. 5,498,303.

[51] Int. Cl.[6] ..... C06B 45/10

[52] U.S. Cl. ..... 149/19.6; 149/19.4

[58] Field of Search ..... 179/19.4, 19.6

[56] References Cited

U.S. PATENT DOCUMENTS

| | | | |
|---|---|---|---|
| 3,609,115 | 9/1971 | Herring . | |
| 3,645,809 | 2/1972 | Stow, Jr. . | |
| 3,680,483 | 8/1972 | Staudacher et al. . | |
| 3,687,954 | 8/1972 | Tyler, III et al. . | |
| 3,811,358 | 5/1974 | Morse . | |
| 3,953,258 | 4/1976 | Sayles . | |
| 4,158,583 | 6/1979 | Anderson . | |
| 4,410,376 | 10/1983 | Bruenner et al. . | |
| 4,707,540 | 11/1987 | Manser et al. . | |
| 4,804,424 | 2/1989 | Hinshaw . | |
| 4,915,755 | 4/1990 | Kim . | |
| 5,076,868 | 12/1991 | Doll et al. . | |
| 5,120,827 | 6/1992 | Willer et al. . | |
| 5,198,204 | 3/1993 | Bottaro et al. . | |
| 5,271,778 | 12/1993 | Bradford et al. . | |
| 5,324,075 | 6/1994 | Sampson | 149/19.9 |
| 5,529,649 | 6/1996 | Lund et al. | 149/19.4 |
| 5,587,553 | 12/1996 | Braithwaite | 149/19.6 |

*Primary Examiner*—Edward A. Miller

*Attorney, Agent, or Firm*—Cushman Darby & Cushman IP Group of Pillsbury; Madison & Sutro, LLP

[57] ABSTRACT

Composite propellant formulations are disclosed having a dinitramide salt oxidizer, such as ammonium dinitramide, an energetic binder, such as energetically substituted oxetane and oxirane polymers, a reactive metal, such as aluminum, and other typical propellant ingredients such as curatives and stabilizers. Propellant formulations useful for minimum smoke or reduced smoke applications, preferably include little or no reactive metal. The disclosed propellant formulations are able to combust the reactive metal efficiently, possess high burn rates, and produce little or no HCl exhaust gases.

21 Claims, No Drawings

PROPELLANT FORMULATIONS BASED ON DINITRAMIDE SALTS AND ENERGETIC BINDERS

RELATED APPLICATION

This application is a continuation-in-part of application Ser. No. 08/052,035, now U.S. Pat. No. 5,498,303 filed Apr. 21, 1993 and entitled "PROPELLANT FORMULATIONS BASED ON DINITRAMIDE SALTS AND ENERGETIC BINDERS," which application is incorporated herein by this reference.

BACKGROUND OF THE INVENTION

1. Field of the Invention

This invention relates to low-hazard solid rocket propellant formulations which use little or no chlorine-containing oxidizers. More specifically, the present invention relates to propellant formulations based on a dinitramide salt oxidizer and an energetic binder.

2. Technology Background

Solid propellants are used extensively in the aerospace industry and are a preferred method of powering most missiles and rockets for military, commercial, and space applications. Solid rocket motor propellants have become widely accepted because they are relatively simple to manufacture and use, and because they have excellent performance characteristics.

Typical solid rocket motor propellants are formulated using an oxidizing agent, a fuel, and a binder. At times, the binder and the fuel may be the same. In addition to the basic components, it is conventional to add various bonding agents, plasticizers, curing agents, cure catalysts, and other similar materials which aid in the processing or curing of the propellant or contribute to mechanical properties improvements of the cured propellant. A significant body of technology has developed related solely to the processing and curing of solid propellants.

Many types of propellants used in the industry use ammonium perchlorate (AP) as the oxidizer. AP has been a preferred oxidizer because of its high energy with relatively low associated hazards, its ability to efficiently oxidize the commonly-used aluminum fuel, and its burn rate tailorability. However, there is some interest in the industry to identify alternative oxidizers having similar attractive properties which do not produce chlorine-containing exhaust products.

A commonly used low-hazard nonchlorine oxidizer is ammonium nitrate (AN). This oxidizer has also been examined in many types of propellants. Unfortunately, AN is well known for its poor performance capability, its inability to combust aluminum efficiently, and the low burn rate of propellants formulated with only AN as the oxidizer. These problems continue to plague nonchlorine propellant development efforts.

Accordingly, it would be a significant advancement in the art to provide propellant formulations of equivalent or improved energy capable combusting aluminum efficiently, providing high propellant burn rates, and producing little or no HCl exhaust emissions.

Such propellant formulations are disclosed and claimed herein.

SUMMARY OF THE INVENTION

The invention is directed to the use of a dinitramide salt as the major oxidizer in combination with an energetic binder in propellant formulations. Such propellants contain no chlorine when the dinitramide salt is the only oxidizer or is used in combination with another nonchlorine oxidizer, or reduced chlorine when the dinitramide salt is used in combination with AP.

The dinitramide salts used according to the present invention have the following general formula: $X^+[N(NO_2)_2]^-$, where $X^+$ is the cationic counterion. Currently preferred counterions are those that complement the energetic properties of the dinitramide anion such as ammonium ion, aminotetrazole ion, urea, biuret, biguanide, N-heterocyclic-containing basic amines, and diaminofurazan ion. Ammonium dinitramide (ADN) is a currently preferred oxidizer according to the present invention.

The propellant formulations of the present invention preferably include an energetic binder, such as energetically substituted oxetane and oxirane polymers (any of which may be either plasticized or unplasticized). Typical energetic substituents include nitromethyl, nitratomethyl, azidomethyl, and difluoroaminomethyl. Reactive metals, such as aluminum, magnesium, aluminum-magnesium alloys, and boron, can also be included in the propellant formulations of the present invention. Propellant formulations useful for minimum smoke or reduced smoke applications, preferably include little or no reactive metal.

It has been found that propellant formulations containing a dinitramide salt, aluminum, and energetic binder possess high burn rates in a range comparable to propellants containing ammonium perchlorate.

DETAILED DESCRIPTION OF THE INVENTION

The present invention is directed to low-hazard solid rocket propellant formulations which do not require use of a chlorine-containing oxidizer. Dinitramide salts are used in combination with energetic binders to produce composite propellant formulations having high burn rates and performance comparable to conventional propellants based on ammonium perchlorate. Importantly, the propellants of the present invention do not produce high levels of chlorine-containing exhaust products. A method of forming dinitramide salts is disclosed in U.S. Pat. No. 5,198,204, granted Mar. 30, 1993, which is incorporated herein by reference.

The dinitramide salts used according to the present invention have the following general formula: $X+[N(NO_2)_2]^-$, where $X^+$ is the cationic counterion. Currently preferred counterions are those that complement the energetic properties of the dinitramide anion such as ammonium ion ($NH_4^+$), aminotetrazole ion, having the following structure:

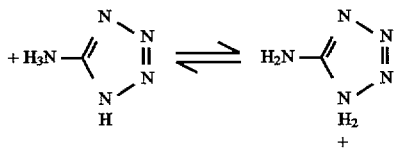

urea, biuret, biguanide, and diaminofurazan ion having the following structure:

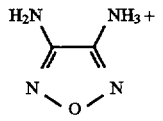

Cations of nitrogen containing heterocycles having the following general structure are preferred.

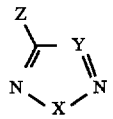

Where X is N, O, or $CH_2$; Y is N, $CNH_2$, CH, or $CNO_2$; and Z is H, $NH_2$, or $NHNO_2$. Cations based on polycyclic polyamines such as bitetrazole, azobitetrazole, bitetrazoleamine, azoaminobitetrazole, analogous triazoles, and the like are also preferred counterions. Other possible cationic counterions which can be used with dinitramide anions include 1–8 nitrogen-containing cations of the formula $(R''_kH_mN_n)^{+z}$, wherein n=1 to 8, k=0 to 2+n, z=1 to n, m=3+n−k, and each R" is the same or different 1–6 carbon straight chain or branched alkyl. Examples of such ions include $NH_4^+$, $CH_3NH_3^+$, $(CH_3)_2NH_2^+$, $(CH_3)_3NH^+$, $(CH_3)_4N^+$, $C_2H_5NH_4^+$, $(C_2H_5)_2NH_2^+$, $(C_2H_5)_3NH^+$, $(C_2H_5)_4N^+$, $(C_2H_5)(CH_3)NH_2^+$, $(C_2H_5)(CH_3)_2NH^+$, $(C_2H_5)_2(CH_3)_2N^+$, $(C_3H_7)_4N^+$, $(C_4H_9)_4N^+$, $N_2H_5^+$, $CH_3N_2H_4^+$, $(CH_3)_2N_2H_3^+$, $(CH_3)_3N_2H_2^+$, $(CH_3)_4N_2H^+$, $(CH_3)_5N_2^+$, etc. Ammonium dinitramide (ADN) is a currently preferred oxidizer according to the present invention.

Energetic binders which are used in the propellant formulations of the present invention include energetically substituted oxetane, oxirane polymers, and nitramine polymers (any of which may be either plasticized or unplasticized). Typical energetic substituents include nitromethyl, nitratomethyl, azidomethyl, and difluoroaminomethyl. A currently preferred class of energetically substituted oxetane polymers is represented by the following formula:

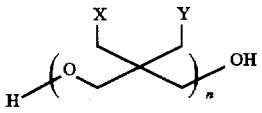

where X is $—NO_2$, $—ONO_2$, $—N_3$, $—NF_2$, or —H and Y is $—NO_2$, $—ONO_2$, $—N_3$, or $—NF_2$. The 3,3-disubstituted oxetanes are preferred over other substitution, such as the 2,4-disubstituted oxetanes, because they are easier to prepare and less expensive.

A currently preferred class of energetically substituted oxirane polymers is represented by the following formula:

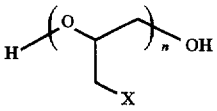

where X is $—NO_2$ or $—N_3$. Poly(glycidyl nitrate) and poly(glycidyl azide) are two currently preferred oxirane polymers.

A currently preferred class of nitramine polymers are polyesters based on nitraminodiacetic acid and a diol or mixture of diols. Suitable diols are aliphatic diols containing from 2–6 carbon atoms and primary alcohol functional groups. The diol can contain ether linkages, but the diol molecule preferably does not also contain an ester or ketone. Examples of suitable diols include 1,2-ethanediol, 1,3-propanediol, 1,4-butanediol, 1,5-pentanediol, 1,6-hexanediol, diethyleneglycol, triethyleneglycol, tetraethyleneglycol, and 2,2-dinitro-1,3-propanediol.

Specific energetic binders useful in the present invention include PGN (poly(glycidyl nitrate)), poly-NMMO (poly (nitratomethyl-methyloxetane)), GAP (glycidyl azide polymer), 9DT-NIDA (diethyleneglycoltriethyleneglycol-nitraminodiacetic acid terpolymer), poly-BAMO (poly (bisazido-methyloxetane)), poly-AMMO (poly (azidomethyl-methyloxetane)), poly-NAMMO (poly (nitraminomethyl-methyloxetane)), copoly-BAMO/NMMO, copoly-BAMO/AMMO, and mixtures thereof.

Reactive metals, such as aluminum, magnesium, aluminum-magnesium alloys, and boron, are optionally included in the the performance requirements of the propellant formulation. For those propellant formulations designed to produce little or no smoke, little or no reactive metal is used.

A typical solid propellant formulation within the scope of the present invention has the following ingredients:

| Ingredient | Weight % |
|---|---|
| Energetic binder | 10–35 |
| Reactive metal | 0–25 |
| Dinitramide salt | 50–70 |
| Curatives/stabilizers | 2–5 |

The lower range of reactive metal (about 0% to 5%, preferably 1% to 5%) includes "reduced smoke" formulations, while the upper limit (25%) covers typical composite propellant formulations. Solids loadings in the range from about 65% to 90%, by weight, are typical. Solids loadings from 70% to 80%, by weight, according to the present invention, provide energy comparable to conventional composite propellant formulations at 88–90% solids containing an inert binder such as HTPB and AP oxidizer. The lower oxidizer loadings contribute to reduced hazards, and the lower reactive metal loadings contribute to reduced exhaust particulates.

The following examples are offered to further illustrate the present invention. These examples are intended to be purely exemplary and should not be viewed as a limitation on any claimed embodiment.

EXAMPLE 1

A composite propellant formulation having 72% solids was prepared having the following ingredients:

| Ingredient | Weight % |
|---|---|
| PGN | 24.4 |
| Al (30 μm) | 13 |
| ADN | 59 |
| Curatives/Stabilizers | 3.6 |

The curatives and stabilizers included 0.4% $NO_x$ scavenger MNA (N-methyl-p-nitroaniline), 3.11% Desmodur® N-100, a polyisocyanate curative obtained from Mobay, 0.05% acid scavenger (N,N,N',N'-tetramethyl-1,8-naphthalenediamine, obtained from Aldrich), and 0.005% cure catalyst TPB (triphenyl bismuth).

The PGN (poly(glycidyl nitrate)), MNA, and acid scavenger were added to a warm mixer bowl (120° F.) and mixed at slow speed for 10 minutes. The aluminum was added and mixed at slow speed for 5 minutes. The ADN was added in one third increments over 30 minutes. All ingredients were then mixed for an additional 10 minutes under vacuum. Finally, the isocyanate curative and TPB were added and mixed at low speed for 10 minutes under vacuum. The propellant was cast and cured at 120° F. for 6 days.

The composite propellant had a burn rate at 1000 psi of 0.76 ips. By way of comparison, the burn rate of similar propellant formulations containing AN as the oxidizer have burn rates of about 0.2 ips at 1000 psi. The composite propellant had a pressure exponent from 500 to 1800 psi of 0.67 with a slope break observed near 2000 psi. Optical bomb tests show desirable ease of ignition and efficient aluminum combustion characteristics, comparable to AP and much better than other nonchlorine oxidizers such as AN. The thermo-chemically predicted performance of the ADN formulation is significantly better than either the AN or AP oxidized analogous formulations, according to the calculations summarized in Table 1, below.

Safety tests of this composite propellant indicate no ESD (electrostatic discharge) sensitivity due to the polar binder. Impact sensitivity was typical of a Class 1.3 composite (nondetonable) propellant, while friction sensitivity was slightly greater than a typical Class 1.3 composite propellant.

EXAMPLE 2

A composite propellant formulation having 72% solids is prepared according to Example 1, except that 5% aluminum and 67% ADN, by weight are included. It is expected that this propellant formulation has a slightly slower burn rate with cooler flame temperature than the propellant of Example 1. Significantly, the energy of this reduced smoke propellant is similar to metallized (16% Al) composite/AP propellant formulations, as summarized in Table 1, below.

EXAMPLE 3

A composite propellant formulation having 72% solids is prepared according to Example 1, except that 18% aluminum and 54% ADN, by weight are included. It is expected that this propellant formulation has additional performance enhancement with a possibly reduced pressure exponent than the propellant of Example 1, as summarized in Table 1, below.

EXAMPLE 4

A composite propellant formulation having 72% solids is prepared according to Example 1, except that 14.75% ammonium perchlorate (200 μm), by weight, replaces a like amount of the ammonium dinitramide. It is thermochemically predicted that this propellant formulation would contain about 4.5% HCl in its exhaust which is a significant reduction over standard AP propellant formulations. Processing may be improved, compared to the propellant formulation of Example 1. The presence of AP in the formulation adds another variable for ballistic control.

EXAMPLE 5

A composite propellant formulation having 72% solids is prepared according to Example 1, except that 20% ammonium nitrate (200 μm), by weight, replaces a like amount of the ammonium dinitramide. It is expected that this nonchlorine propellant formulation may have a reduced burn rate, compared to the propellant formulation of Example 1, as summarized in Table 1, below. However, it is also expected that this formulation will have lower cost and likely reduced hazards sensitivity, while maintaining very good performance.

Theoretical performance calculations using the NASA-Lewis thermochemical code were performed on the propellant compositions of Examples 1–5 which are summarized below in Table 1:

TABLE 1

| | Ex. 1 | Ex. 2 | Ex. 3 | Ex. 4 | Ex. 5 |
|---|---|---|---|---|---|
| Ingredient | | | | | |
| Al | 13.00 | 5.00 | 18.00 | 13.00 | 13.00 |
| AP | -0- | -0- | -0- | 14.75 | -0- |
| AN | -0- | -0- | -0- | -0- | 20.00 |
| ADN | 59.00 | 67.00 | 54.00 | 44.25 | 39.00 |
| Binder/curative | 28.00 | 28.00 | 28.00 | 28.00 | 28.00 |
| Property | | | | | |
| Density lb/in$^3$ | 0.0628 | 0.0612 | 0.0638 | 0.0635 | 0.0622 |
| ΔIsp, sec† | +8.24 | +4.17 | +9.15 | +5.70 | +3.06 |
| ΔIsp · Density | +0.14 | −0.58 | +0.50 | +0.19 | −0.35 |
| Flame Temp., °C. | 3263 | 2997 | 3410 | 3272 | 3100 |
| % HCl, Exhaust | -0- | -0- | -0- | 4.49 | -0- |

†As compared to a production composite AP propellant formulation (16% Al).

From the data depicted in Table 1, it can be appreciated that ADN may either fully or partially replace AP as an oxidizer in propellant formulations without greatly sacrificing propellant performance, even at reduced metal loadings (13% Al versus the 16% Al comparison propellant). There is some reduction in propellant density, but a significant increase in Isp offsets this reduction. Importantly, the quantity of HCl in the propellant exhaust products can be eliminated or substantially reduced. In the reduced smoke formulation, Example 2, 5% Al expectedly gives lower performance than the highly metallized formulations, but the energy for this class of propellants is very good.

EXAMPLE 6

Theoretical performance calculations using the NASA-Lewis thermochemical code were performed on propellant compositions containing 13% Al, 59% oxidizer (either ADN, AP, or AN), and 28% PGN binder/curative.

TABLE 2

Theoretical Performance Comparison of ADN, AP, and AN in PGN-based Propellant

| | Oxidizer | | |
|---|---|---|---|
| | ADN | AP | AN |
| Ingredient | | | |
| Al | 13.00 | 13.00 | 13.00 |
| AP | -0- | 59.00 | -0- |
| AN | -0- | -0- | 59.00 |
| ADN | 59.00 | -0- | -0- |
| Binder/curative | 28.00 | 28.00 | 28.00 |

TABLE 2-continued

Theoretical Performance Comparison of ADN, AP, and AN in PGN-based Propellant

| | Oxidizer | | |
|---|---|---|---|
| | ADN | AP | AN |
| Property | | | |
| Density, lb/cu. in. | 0.06276 | 0.06563 | 0.06124 |
| Isp, sec. | 293.53 | 282.97 | 276.05 |
| $(\text{Density})^{0.75}(\text{Isp})$ | 36.81 | 36.69 | 33.98 |
| Flame Temperature, °C. | 3263 | 3291 | 2733 |
| Measured Burn rate @ 1000 psi, ips | 0.76 | 0.3–0.4 | 0.2–0.3 |

Isp = Isp(vac) at $P_c$ = 1000 psi, Expansion Ratio ($A_e/A_t$) = 10 ($A_e$ = area of exit and $A_t$ = area of throat). $(\text{Density})^{0.75}(\text{Isp})$ is a common performance/volume efficiency comparison.

From the results reported in Table 2, the energy-density for the ADN composition is superior to the AP-analogue; the lower density of ADN is offset by its extremely high Isp. Although hydrocarbon binders, such as HTPB or PBAN are most commonly used and represent the obvious choice, they are not selected herein because of binder compatibility problems discussed below.

ADN propellant compositions containing an energetic binder provide a significant advantage over known non-chlorine propellant compositions because the high energy-density can be obtained at lower oxidizer loadings and lower Al loadings. The lower oxidizer loadings contribute to reduced hazards, and the lower Al loadings contribute to reduced exhaust particulates.

EXAMPLE 7

Propellant compositions containing the combination of ADN and PGN produce energy competitive with current high solids, AP-oxidized propellants, as reported in Table 3.

TABLE 3

ADN Propellant Comparison with Commercial Class 1.3 Composite Propellants

| Binder | PGN | HTPB[a] | PBAN[b] |
|---|---|---|---|
| Oxidizer (wt. %) | 59% ADN | 68.9% AP | 70% AP |
| Fuel (wt. %) | 13% Al | 19% Al | 16% Al |
| Total Solids | 72% | 88% | 86% |
| Density, lb/cu. in. | 0.06276 | 0.06518 | 0.06408 |
| Isp, sec* | 293.53 | 287.23 | 285.29 |
| $(\text{Density})^{0.75}(\text{Isp})$ | 36.81 | 37.05 | 36.34 |
| Flame Temp., °C. | 3262 | 3290 | 3154 |
| $Al_2O_3$ (exit), mass fraction | 0.25 | 0.35 | 0.30 |

*Isp = Isp(vac) at $P_c$ = 1000 psi, $A_e/A_t$ = 10.
[a]Castor 120 ® propellant formulation, including $Fe_2O_3$ catalyst.
[b]Space shuttle propellant formulation, excluding $Fe_2O_3$ catalyst.

EXAMPLE 8

A composite propellant formulation having 72% solids is prepared according to Example 1, except that ammoniumtetrazole (ATDN) replaces the ammonium dinitramide. It is expected that this nonchlorine propellant formulation may have slightly reduced energy, compared to the propellant formulation of Example 1. However, it is also expected that this formulation will have a lower flame temperature, while maintaining very good performance.

EXAMPLE 9

A composite propellant formulation having 72% solids is prepared according to Example 1, except that aminoammoniumfurazan (DAFDN) replaces the ammonium dinitramide. It is expected that this nonchlorine propellant formulation may have slightly reduced energy, compared to the propellant formulation of Example 1. However, it is also expected that this formulation will have a lower flame temperature, while maintaining very good performance.

Theoretical performance calculations in which the oxidizer dinitramide counter ion is ammoniumtetrazole (ATDN) or the aminoammoniumfurazan (DAFDN) (Examples 8 and 9) are shown below in Table 4:

TABLE 4

| | Ex. 8 | Ex. 9 |
|---|---|---|
| Ingredient | | |
| Al | 13.00 | 13.00 |
| ATDN | 59.00 | -0- |
| DAFDN | -0- | 59.00 |
| Binder/curative | 28.00 | 28.00 |
| Property | | |
| Density lb/in$^3$ | 0.0626 | 0.0624 |
| ΔIsp, sec† | −2.01 | −0.01 |
| ΔIsp · Density | −0.56 | −0.49 |
| Flame Temp., °C. | 3017 | 2972 |
| % HCl, Exhaust | -0- | -0- |

†As compared to a production composite AP propellant formulation (16% Al).

While slightly lower in energy than the analogous ADN formulation (Example 1 of Table 1), the formulations depicted in Table 4 can be useful in systems requiring a cooler flame temperature or a lower oxygen/fuel ratio for exhaust species modification. Because these ATDN and DAFDN oxidizers have a lower oxygen content, they would also be useful in reduced smoke (0%–5% metal) formulations.

EXAMPLE 10

Theoretical performance calculations using the NASA-Lewis thermochemical code were performed on propellant compositions containing 13% Al, 59% ADN and a variety of different energetic binders within the scope of the present invention. The results of these calculations are reported below in Table 5. The PGN formulation of Example 1 is included for comparison.

TABLE 5

| Binder polymer/ plasticizer | NMMO | NMMO/ BuNENA | BAMO—AMMO/ GAP—P | GAP/ GAP—P | 9DT— NIDA | PGN |
|---|---|---|---|---|---|---|
| Pl/Po | — | 1.0 | 2.0 | 2.0 | — | — |
| Density, lb/in$^3$ | 0.06021 | 0.05979 | 0.05995 | 0.06022 | 0.06134 | 0.06276 |

TABLE 5-continued

| Binder polymer/ plasticizer | NMMO | NMMO/ BuNENA | BAMO—AMMO/ GAP—P | GAP/ GAP—P | 9DT— NIDA | PGN |
|---|---|---|---|---|---|---|
| Isp, sec* | 292.77 | 295.50 | 295.96 | 295.24 | 286.19 | 293.53 |
| Density$^{(0.75)}$ · Isp | 35.59 | 35.73 | 35.86 | 35.89 | 35.27 | 36.81 |
| Flame Temp., °C. | 3034 | 3084 | 3062 | 3086 | 3026 | 3262 |

*Isp = Isp(vac) at $P_c$ = 1000 psi, $A_e/A_t$ = 10.

The energetic plasticizer BuNENA is butyl nitratoethylnitramine and GAP-P is GAP plasticizer. GAP plasticizer has the same polymer backbone as GAP, but is terminated with non-reactive end groups instead of hydroxyl groups.

These formulations illustrate the utility of the energetic oxetanes, oxiranes, and nitramine polymers. The Isp values show the performance improvement potential over typical Class 1.3 composite propellants like 86 percent solids, 16 percent aluminum PBAN propellant (Isp=285.29) or 88 percent solids, 19 percent aluminum HTPB propellant (Isp=287.23). These performance numbers are particularly impressive because the ADN formulations are relatively low solids, low metal, and totally non-chlorine.

Although the propellant formulations shown above are all at 72 weight percent solids and 13% aluminum to facilitate comparison with the previously reported PGN propellant formulation, the propellant formulations have not been optimized for performance. It is likely each system will be optimized for overall performance at slightly different ingredient weight percents. The optimum performance will likely be improved slightly compared to the numbers reported above.

From the foregoing it will be appreciated that the present invention provides propellant formulations exhibiting efficient aluminum combustion and high propellant burn rates, while producing reduced or no chlorine-containing exhaust products. The propellant formulations also provide excellent performance in reduced smoke applications.

The invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A composite propellant formulation comprising:

an energetic binder in the range from about 10% to about 35% by weight of the composite propellant formulation, wherein the energetic binder is selected from energetically substituted oxetane polymers having a formula:

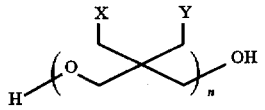

where X is —$NO_2$, —$ONO_2$, —$N_3$, —$NF_2$, or —H and Y is —$NO_2$, —$ONO_2$, —$N_3$, or —$NF_2$, energetically substituted oxirane polymers having a formula:

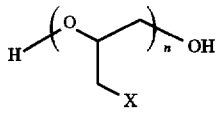

where X is —$NO_2$ or —$N_3$, and energetic nitramine polyester polymers based on nitraminodiacetic acid and a diol or mixture of diols, wherein said diol is an aliphatic diol containing from 2–6 carbon atoms and primary alcohol functional groups;

a solids loading of from about 65 to 90% by weight of the composite propellant formulation, wherein said solids loading comprises:

a dinitramide salt oxidizer; and a reactive metal; and a polyfunctional curative.

2. A composite propellant formulation as defined an claim 1, wherein the dinitramide salt oxidizer is ammonium dinitramide (ADN).

3. A composite propellant formulation as defined in claim 1, wherein the dinitramide salt oxidizer is tetrazolium dinitramide.

4. A composite propellant formulation as defined in claim 1, wherein the dinitramide salt oxidizer is ammonium-tetrazole dinitramide.

5. A composite propellant formulation as defined in claim 1, wherein the dinitramide salt oxidizer is aminoammoniumfurazan dinitramide.

6. A composite propellant formulation as defined in claim 1, wherein the energetic binder is poly(glycidyl nitrate).

7. A composite propellant formulation as defined in claim 1, wherein the energetic binder is poly(glycidyl azide).

8. A composite propellant formulation as defined in claim 1, wherein the energetic binder is an energetically substituted oxetane polymer selected from poly-NMMO (poly (nitratomethyl-methyloxetane)), poly-BAMO (poly (bisazido-methyloxetane)), poly-AMMO (poly (azidomethyl-methyloxetane)), poly-NAMMO (poly (nitraminomethyl-methyloxetane)), copoly-BAMO/NMMO, copoly-BAMO/AMMO, and mixtures thereof.

9. A composite propellant formulation as defined in claim 1, wherein the energetic binder is 9DT-NIDA (diethyleneglycoltriethyleneglycolnitraminodiacetic acid terpolymer).

10. A composite propellant formulation as defined in claim 1, wherein the reactive metal has a concentration greater than 5% by weight.

11. A composite propellant formulation as defined in claim 1, wherein the reactive metal is aluminum.

12. A composite propellant formulation as defined in claim 1, wherein the reactive metal is magnesium.

13. A composite propellant formulation as defined in claim 1, wherein the reactive metal is an aluminum-magnesium alloy.

14. A composite propellant formulation as defined in claim 1, wherein the reactive metal is boron.

15. A composite propellant formulation as defined in claim 1, further comprising from about 0% to about 15% by weight ammonium perchlorate, wherein the combined amount of the ammonium perchlorate and the dinitramide salt oxidizer in the composite propellant formulation does not exceed about 70% by weight.

16. A composite propellant formulation as defined in claim 1, further comprising from about 0% to about 20% by weight ammonium nitrate, wherein the combined amount of ammonium nitrate and the dinitramide salt oxidizer in the composite propellant formulation does not exceed about 70% by weight.

17. A composite propellant formulation comprising:

an energetically substituted oxetane polymer binder in the range from about 10% to about 35% by weight of the composite propellant formulation, wherein the energetically substituted oxetane polymer has a formula:

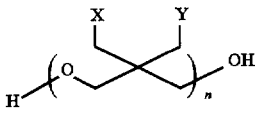

where X is —$NO_2$, —$ONO_2$, —$N_3$, —$NF_2$, or —H and Y is —$NO_2$, —$ONO_2$,—$N_3$,or —$NF_2$;

a solids loading of from about 65 to 90% by weight of the composite propellant formulation, wherein said solids loading comprises:

a dinitramide salt oxidizer selected from ammonium dinitramide (ADN), tetrazolium dinitramide, armmoniumtetrazole dinitramide, aminoammoniumfurazan dinitramide, and mixtures thereof; and a reactive metal selected from aluminum, magnesium, aluminum-magnesium alloys, boron, and mixtures thereof; and a polyfunctional curative.

18. A composite propellant formulation comprising:

an energetically substituted oxirane polymer binder in the range from about 10% to about 35% by weight of the composite propellant formulation, wherein the energetically substituted oxirane polymer has a formula:

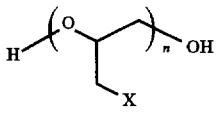

where X is —$NO_2$ or —$N_3$;

a dinitramide salt oxidizer in the range from about 50% to about 70% by weight of the composite propellant formulation, wherein the dinitramide salt oxidizer is selected from ammonium dinitramide (ADN), tetrazolium dinitramide, ammoniumtetrazole dinitramide, aminoammoniumfurazan dinitramide, and mixtures thereof;

a reactive metal in the range from about 0% to about 25% by weight of the composite propellant formulation, wherein the reactive metal is selected from aluminum, magnesium, aluminum-magnesium alloys, boron, and mixtures thereof; and a polyfunctional curative.

19. A composite propellant formulation comprising:

an energetic nitramine polyester polymer based on nitraminodiacetic acid and a diol or mixture of diols, wherein said diol is an aliphatic diol containing from 2–6 carbon atoms and primary alcohol functional groups;

a dinitramide salt oxidizer in the range from about 50% to about 70% by weight of the composite propellant formulation, wherein the dinitramide salt oxidizer is selected from ammonium dinitramide (ADN), tetrazolium dinitramide, ammoniumtetrazole dinitramide, aminoammoniumfurazan dinitramide, and mixtures thereof;

a reactive metal in the range from about 0% to about 25% by weight of the composite propellant formulation, wherein the reactive metal is selected from aluminum, magnesium, aluminum-magnesium alloys, boron, and mixtures thereof; and a polyfunctional curative.

20. A composite propellant formulation as defined in claim 19, wherein the diol is selected from 1,2-ethanediol, 1,3-propanediol, 1,4-butanediol, 1,5-pentanediol, 1,6-hexanediol, diethyleneglycol, triethyleneglycol, tetraethyleneglycol, 2,2-dinitro-1,3-propanediol, and mixtures thereof.

21. A composite propellant formulation as defined in claim 1, wherein the energetic binder is poly-NMMO (poly (nitratomethyl-methyloxetane)).

* * * * *